US010729946B2

(12) United States Patent
Aramaki

(10) Patent No.: US 10,729,946 B2
(45) Date of Patent: Aug. 4, 2020

(54) GOLF CLUB SET

(71) Applicant: Sumitomo Rubber Industries, Ltd., Hyogo (JP)

(72) Inventor: Tomotaka Aramaki, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/358,107

(22) Filed: Mar. 19, 2019

(65) Prior Publication Data

US 2019/0290974 A1 Sep. 26, 2019

(30) Foreign Application Priority Data

Mar. 22, 2018 (JP) ..... 2018-055311

(51) Int. Cl.
*A63B 53/04* (2015.01)
*A63B 102/32* (2015.01)
*A63B 53/00* (2015.01)

(52) U.S. Cl.
CPC ..... *A63B 53/0466* (2013.01); *A63B 53/047* (2013.01); *A63B 2053/005* (2013.01); *A63B 2053/0408* (2013.01); *A63B 2053/0437* (2013.01); *A63B 2102/32* (2015.10)

(58) Field of Classification Search
CPC ..... A63B 53/0466; A63B 2102/32; A63B 53/047; A63B 2053/005; A63B 2053/0408; A63B 2053/0437
USPC ..... 473/290, 345
See application file for complete search history.

(56) References Cited

U.S. PATENT DOCUMENTS 4,900,028 A * 2/1990 Antonious ..... A63B 53/04 473/242
5,501,460 A * 3/1996 Scheie ..... A63B 53/04 473/290
8,533,060 B1 * 9/2013 Arluna ..... A63B 53/06 705/26.1
2004/0092328 A1 * 5/2004 Patsky ..... A63B 53/04 473/292
2005/0209018 A1 * 9/2005 Yamamoto ..... A63B 53/047 473/324
2010/0273566 A1 * 10/2010 Matsunaga ..... A63B 53/00 473/290
2016/0354653 A1 * 12/2016 Aramaki ..... A63B 53/0466

FOREIGN PATENT DOCUMENTS

JP 2015-29628 A 2/2015

* cited by examiner

*Primary Examiner* — Michael D Dennis
(74) *Attorney, Agent, or Firm* — Studebaker & Brackett PC

(57) ABSTRACT

A golf club set according to the present invention is constituted by a plurality of golf clubs having different loft angles, each of the golf clubs has a shaft and a golf club head, and each of the golf club heads have a crown part, a face part, a sole part, and a hosel part to which the shaft is attached. In the face part, an upper edge line that is a boundary with the crown part curves so as to protrude upward, and, out of the plurality of golf clubs, at least a pair of a first golf club having a lower loft angle and a second golf club having a higher loft angle are configured such that, in a reference state, an uppermost point of the upper edge line of the second golf club is located further on a toe side than in the first golf club.

6 Claims, 9 Drawing Sheets

E1 cross-section

GOLF CLUB SET

TECHNICAL FIELD

The present invention relates to a golf club set.

BACKGROUND ART

A golf club set typically includes multiple clubs having different loft angles (e.g., JP 2015-29628A). Clubs having low loft angles are used to achieve longer flight distances. On the other hand, clubs having high loft angles are used for shots when near the green, where the player often aims for the small area of the green. As such, when using clubs having high loft angles, putting more backspin on the ball is effective in order to stop the ball on the green. During a game, golf clubs are selected from the golf club set in accordance with purposes such as the above.

JP 2015-29628A is an example of the related art.

SUMMARY OF THE INVENTION

Incidentally, when a golf club is selected from a golf club set such as the above, although the design of the golf clubs is uniform, the golf club head looks different for each golf club when addressing the ball, due to the difference in the loft angles. As such, when playing a shot using a different golf club, the player may feel a sense of incongruity and have trouble addressing the ball. The present invention was made in order to solve this problem, and an object of the present invention is to provide golf club heads that can reduce the sense of incongruity felt at address between multiple golf clubs.

A golf club set according to the present invention is constituted by a plurality of golf clubs having different loft angles, wherein each of the golf clubs includes a shaft and a golf club head; each of the golf club heads includes: a crown part; a face part; a sole part; and a hosel part to which the shaft is attached, and in the face part, an upper edge line that is a boundary with the crown part curves so as to protrude upward. Out of the plurality of golf clubs, at least a pair of a first golf club having a lower loft angle and a second golf club having a higher loft angle are configured such that, in a reference state, an uppermost point of the upper edge line of the second golf club is located further on a toe side than in the first golf club.

In the above-mentioned golf club set, when a curvature radius of an arc that passes through three points on the upper edge line of each of the golf clubs is defined, the three points being the uppermost point, a heel-side end point that is an intersection point between the upper edge point and a plane that passes through an intersection point between a center axis line of the shaft in the reference state and a placement surface of the golf club head and is perpendicular to the toe-heel direction, and a midpoint between the uppermost point and the heel-side end point in the toe-heel direction, the curvature radius of the second golf club may be larger than the curvature radius of the first golf club.

In the above-described golf club set, a difference between the curvature radius of the first golf club and the curvature radius of the second golf club may be within 70 mm.

In the above-described golf club set, the plurality of golf clubs may include a golf club that has a curvature radius of 120 to 220 mm.

With the golf club set according to the present invention, it is possible to reduce the sense of incongruity felt at address between multiple golf clubs.

EMBODIMENTS OF THE INVENTION

An embodiment of a golf club set according to the present invention will be described hereinafter with reference to the drawings. The golf clubs constituting the golf club set according to the present embodiment are utility type (also called "hybrid type") golf clubs. The clubs are, for example, #2 to #8 utilities, having club lengths from 36 to 42 inches and loft angles from 15 to 35°. As will be described later, the clubs differ mainly in terms of the loft angle and so on. The following will first use a single golf club as an example to give a general overview of the structures common to the clubs. Then, the differences between the golf clubs in the golf club set will be described in detail.

1. Overview of Golf Club Head

Figure 1:
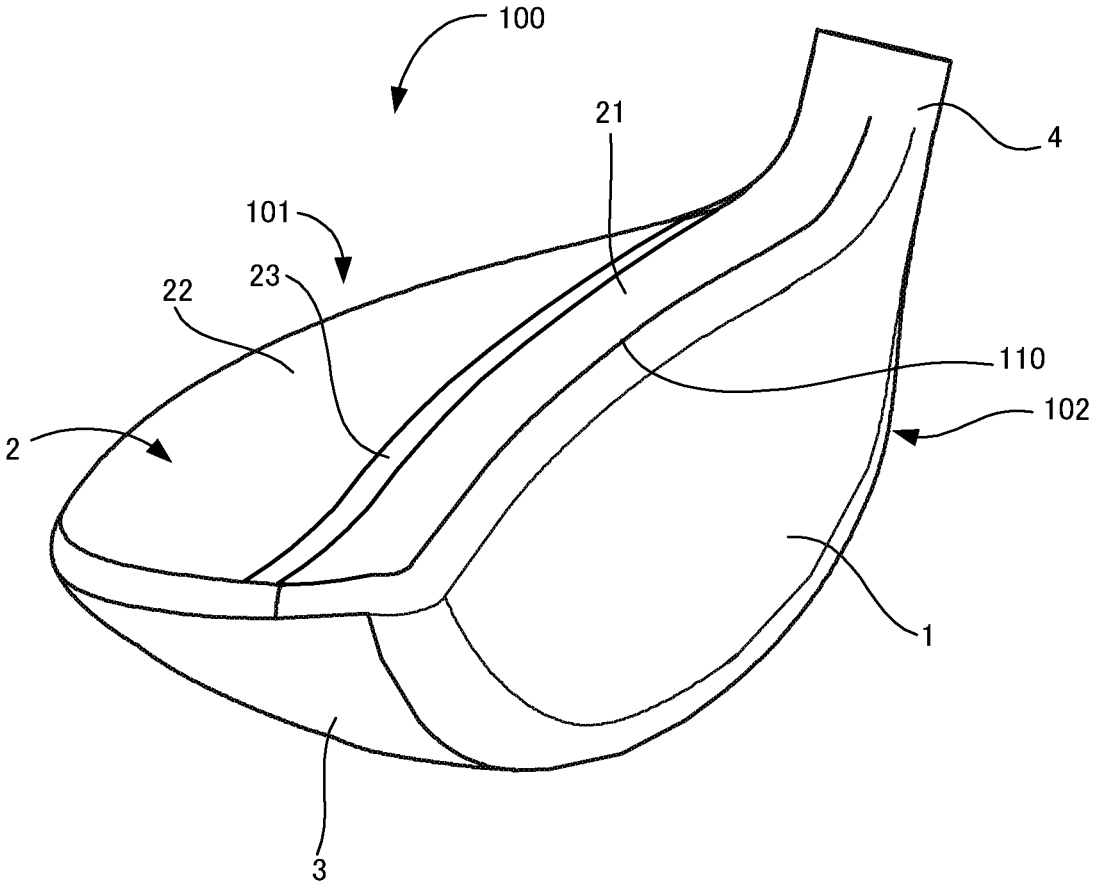
FIG. 1 is a perspective view of a golf club head included in a golf club set according to an embodiment of the present invention.
Figure 2:
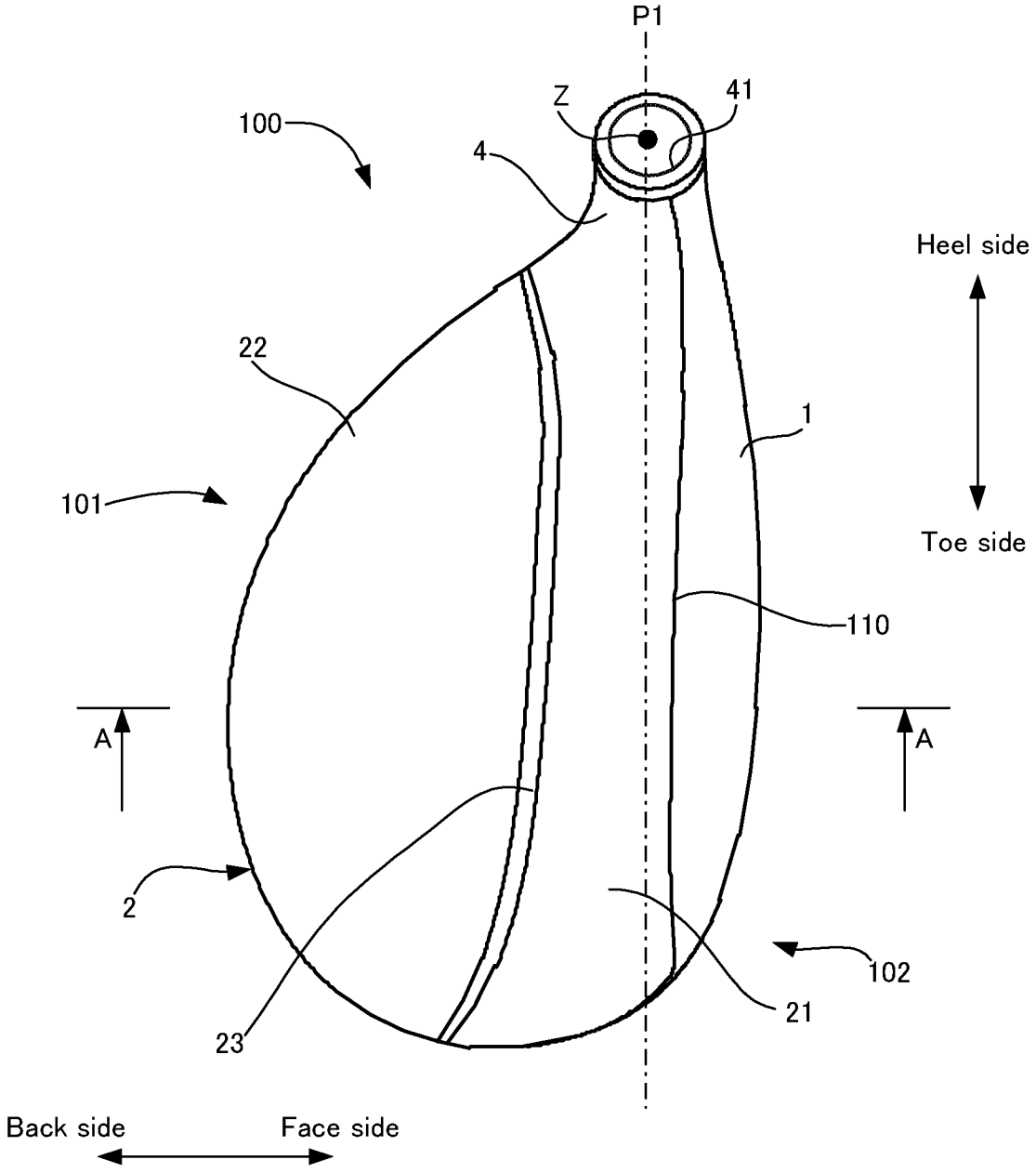
FIG. 2 is a plan view of the golf club head in FIG. 1 in a reference state.
Figure 3:
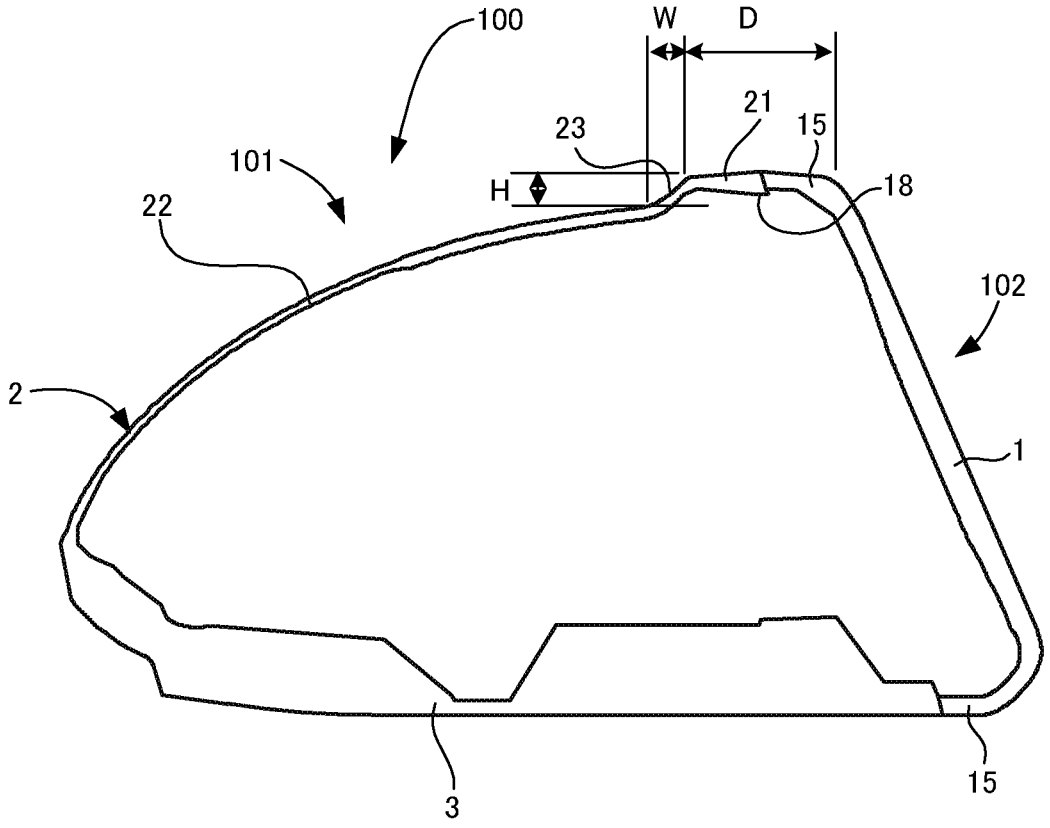
FIG. 3 is a cross-sectional view taken along A-A in FIG. 2.

First, a single golf club (e.g., a utility type golf club) in the golf club set according to the present embodiment will be used as an example to describe the golf club head. FIG. 1 is a perspective view of a single golf club head in the golf club set according to the present embodiment, shown in a reference state. FIG. 2 is a plan view corresponding to FIG. 1. FIG. 3 is a cross-sectional view taken from a line A-A in FIG. 2. The reference state of the golf club head will be described later.

As illustrated in FIGS. 1 to 3, the golf club head (also sometimes called simply a "head" hereinafter) 10 is a utility type golf club head. The head has a hollow construction with an internal space, and wall surfaces are formed by a face part 1, a crown part 2, a sole part 3, and a hosel part 4.

The face part 1 has a face surface, which is a surface that strikes a ball. The crown part 2 is adjacent to the face part 1 and forms an upper surface of the head 100. The sole part 3 mainly forms a bottom surface of the head 100, and constitutes the outer peripheral surface of the head 100 excluding the face part 1 and the crown part 2. In other words, in addition to the bottom surface of the head 100, a part extending from a toe side of the face part 1, across a backside of the head 100, and to a heel side of the face part 1 is part of the sole part 3. Furthermore, the hosel part 4 is a part provided adjacent to a heel side of the crown part 2, and has an insertion hole 41 into which a shaft (not shown)

of a golf club is inserted. A center axis line Z of the insertion hole 41 coincides with an axis line of the shaft.

A reference state when the golf club head 100 is placed on the ground surface will be described next. First, as illustrated in FIG. 2, a state in which the center axis line Z is contained in a plane P1 perpendicular to the ground surface and the head is placed on the ground surface at a prescribed lie angle and real loft angle is defined as the "reference state". The plane P1 is called a "reference vertical plane". Also, as illustrated in FIG. 2, the direction of an intersecting line between the reference vertical plane P1 and the ground surface is called a "toe-heel direction", and a direction perpendicular to the toe-heel direction and parallel to the ground surface is called a "face-back direction". Also, a direction that is orthogonal to the toe-heel direction and the face-back direction is called an "up-down direction" in some cases.

Figure 4A:
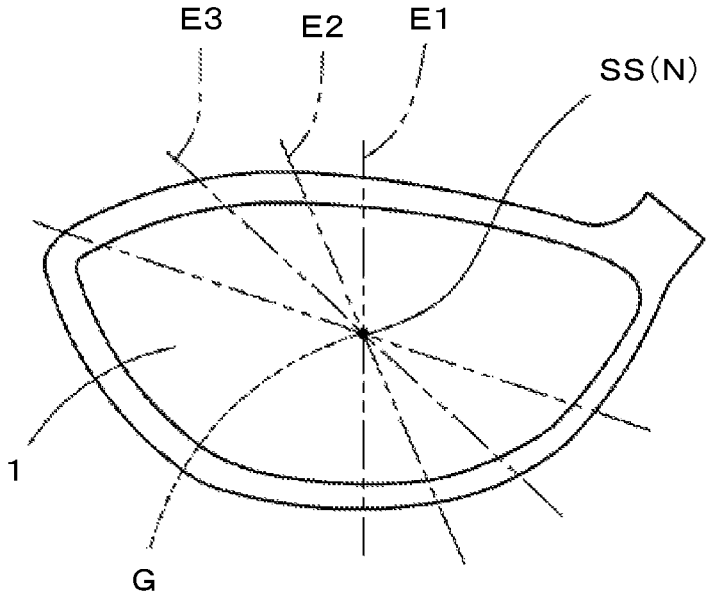
FIG. 4A is a diagram illustrating the boundaries of a face part.
Figure 4B:
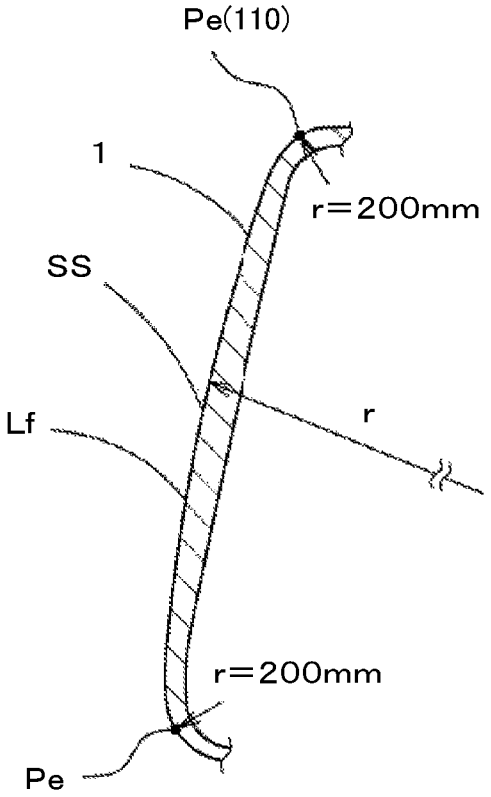
FIG. 4B is a diagram illustrating the boundaries of the face part.

In the present embodiment, a boundary between the face part 1 and the crown part 2 and a boundary between the face part 1 and the sole part 3 can be defined as follows. If a ridge line is formed between these parts, that ridge line serves as the boundary. However, if a clear ridge line is not formed, the boundaries are defined as follows. In each of cross-sections E1, E2, E3, and so on illustrated in FIG. 4A, each of which contains a straight line N connecting a head center of gravity G with a sweet spot SS, a position Pe where a curvature radius r of a face outer surface contour line Lf first reaches 200 mm while moving from the sweet spot side toward the face outer side, as illustrated in FIG. 4B, serves as a peripheral edge of the face part 1. This is defined as the boundary with the crown part 2 or the sole part 3. The "sweet spot SS" is a point of intersection between a normal line of the face surface passing through the head center of gravity G (the straight line N) and that face surface. Also, in this specification, out of the above-described boundaries Pe, the boundary between the face part 1 and the crown part 2 is called an upper edge line 110 of the face part 1.

In the present embodiment, a boundary between the crown part 2 and the sole part 3 can be defined as follows. If a ridge line is formed between the crown part 2 and the sole part 3, that ridge line serves as the boundary. However, if a clear ridge line is not formed between these parts, a contour seen from directly above the center of gravity of the head 100 when the head is placed in the reference state serves as the boundary.

The head 100 can be formed of, for example, a titanium alloy (Ti-6Al-4V, Ti-8Al-1Mo-1V, or the like) having a relative density of approximately 4.3 to 4.5. Aside from titanium alloys, the head can be formed using one or more of stainless steel, maraging steel, an aluminum alloy, a magnesium alloy, an amorphous alloy, and so on, for example.

The volume of the golf club head 100 is desirably greater than or equal to 90 $cm^3$ and less than or equal to 200 $cm^3$, for example.

2. Assembly Structure of Golf Club Head

As illustrated in FIG. 3, the golf club head 100 according to the present embodiment is formed by assembling a head main body 101, which includes the crown part 2 and the sole part 3, with a face member 102, which includes the face part 1 and a peripheral edge part 15 extending from the peripheral edges of the face part 1 to form a cup-like shape. The head main body 101 has an opening 18 surrounded by the crown part 2 and the sole part 3, and the face member 102 is attached so as to cover the opening 18. In other words, an end surface of the peripheral edge part 15 of the face member 102 is butted against an end surface of the opening 18 in the head main body 101, and these end surfaces are joined together by welding (so-called a "cup face construction"). The face member 102 is integrated with the head main body 101 by being attached to the edges of the opening 18 in the head main body 101. As a result, the peripheral edge part 15 of the face member 102 functions as a part of the crown part 2 and the sole part 3 of the head 100.

Accordingly, an integral surface formed by attaching the peripheral edge part 15 of the face member 102 to the head main body 101 forms the crown part 2 and the sole part 3 of the head 100. As such, the crown part 2 and the sole part 3 of the head main body 101 are, strictly speaking, parts of the crown part 2 and the sole part 3 of the head 100. However, this specification may not make this distinction, and the parts of the head main body 101 may also being referred to simply as the crown part 2 and the sole part 3.

3. Structure of Crown Part

The crown part 2 will be described next. As illustrated in FIGS. 1 to 3, the crown part 2 includes a protruding part 21 located on the face part 1 side and a base part 22 located further on the back side than the protruding part 21. The protruding part 21 is mainly a band-shaped region extending along the face part 1 in the toe-heel direction. On the other hand, the base part 22 is a region occupying most of the crown part 2 at a position lower than the protruding part 21, and the peripheral edges of the base part 22 contact the sole part 3. A sloped surface 23, which forms a step, is formed at the boundary between the protruding part 21 and the base part 22. As such, the height of the face part 1 in an up-down direction is higher by the size of the step between the protruding part 21 and the base part 22.

The sloped surface 23 is formed so as to extend downward as the sloped surface 23 progresses toward the back. Thus when the golf club head 100 is placed in the reference state, the sloped surface 23 can be seen from above. In other words, the sloped surface 23 can be seen by a golfer in the address position. The sloped surface 23 is formed along the protruding part 21, and thus like the protruding part 21, is formed in a band shape when viewed in plan view.

As illustrated in FIG. 3, a width D of the protruding part 21 in the face-back direction is, for example, preferably from 5 to 25 mm and more preferably from 7 to 20 mm, when viewed in plan view.

Additionally, a width W of the sloped surface 23 in the face-back direction when viewed in plan view is, for example, preferably from 1 to 9 mm and more preferably from 2 to 7 mm. Furthermore, a height H of the sloped surface 23 is, for example, preferably from 0.5 to 8 mm, more preferably from 0.5 to 6 mm, and particularly preferably from 0.5 to 5 mm.

4. Method of Manufacturing Golf Club Head

An example of a method of manufacturing the above-described golf club head will be described next. First, the above-described head main body 101 and face member 102 are prepared. The head main body 101 and the face member 102 can be manufactured by a variety of methods. For example, the head main body 101 can be manufactured using a known casting method such as lost-wax precision casting. The face member 102 can be manufactured by a forging method, a process of pressing a flat plate, casting, or the like, for example. Also, when the face member 102 is formed by a rolled material, the pre-processing flat plate is processed such that the rolling direction substantially coincides with the direction from an upper part of the face part 1 on the toe side to a lower part on the heel side.

These members are then joined through welding, for example (tungsten-inert gas (TIG) welding, plasma welding, laser welding, brazing, or the like). Then, once predetermined coating has been carried out, the golf club head is complete.

5. Differences Between Golf Clubs in Golf Club Set

Figure 5:
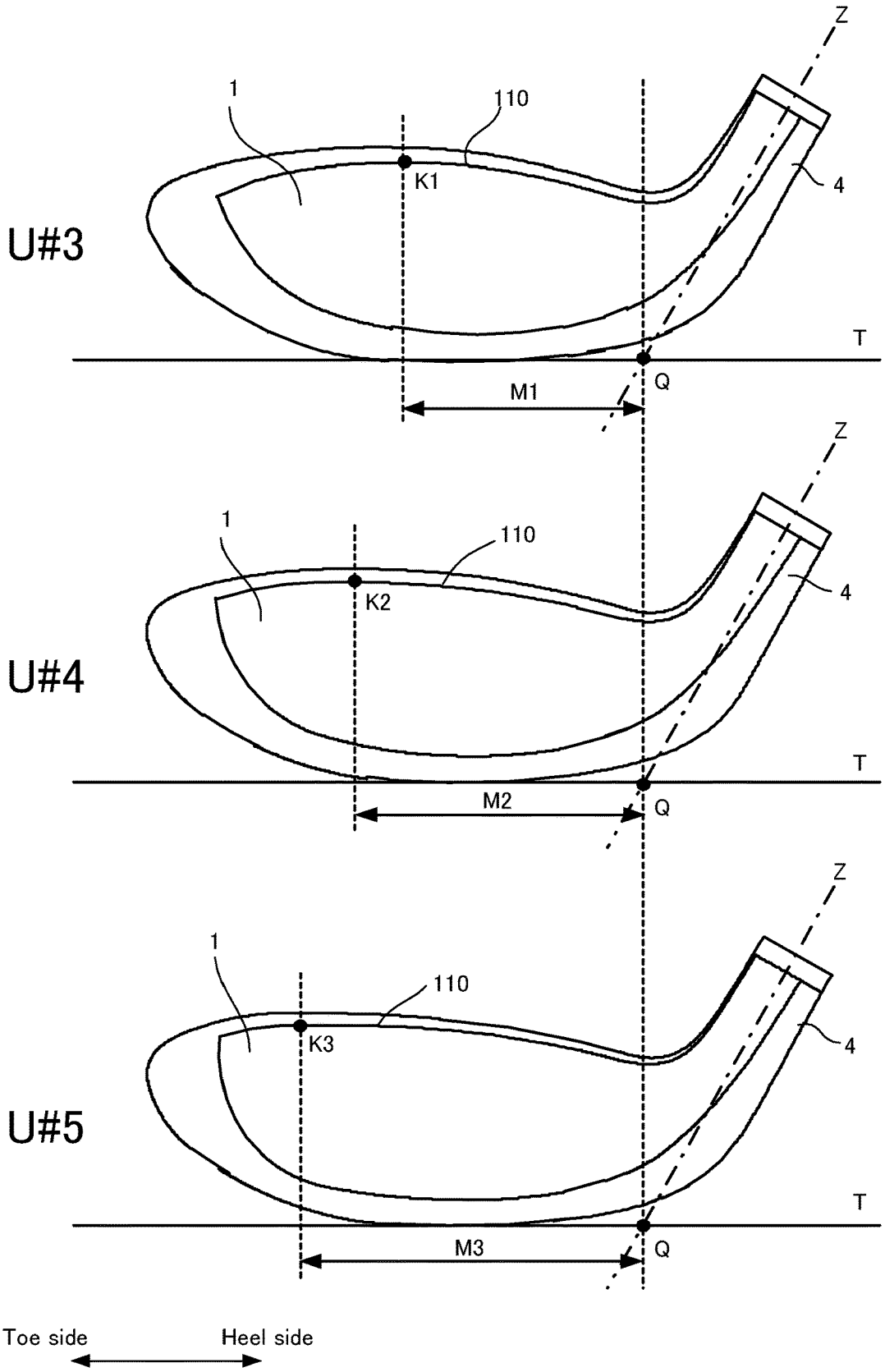
FIG. 5 is a front view of golf club heads having different loft angles that are included in the golf club set according to the present invention.

Next, differences between the golf clubs having different loft angles in the golf club set will be described with reference also to FIG. 5. FIG. 5 is a front view of multiple golf club heads in the reference state when viewed from the face side. FIG. 5 illustrates the heads of three golf clubs, having consecutive numbers, in the golf club set according to the present embodiment as an example. These are arranged in order from top to bottom, in ascending order of loft angle, i.e., a #3 utility (U #3), a #4 utility (U #4), a #5 utility (U #5). Note that in FIG. 5, the heads are illustrated in a slightly exaggerated manner to make the features of the invention with respect to the difference between the golf clubs clear. Thus, the actual dimensions and so on which will be described later are different from those in FIG. 5, but this has no effect on the essence of the invention. Note that dimensions of the heads described hereinafter refer to dimensions in the reference state unless otherwise specified. Here, among any two of the golf clubs (U #3, U #4, and U #5) according to the present embodiment, the club having a lower loft angle corresponds to the first golf club of the present invention, and the club having a higher loft angle corresponds to the second golf club of the present invention.

In FIG. 5, three golf clubs are placed on a placement surface (ground) in the reference state. In this state, with the golf club set according to the present embodiment, the face parts 1 of the golf club heads (U #3, U #4, and U #5) are configured such that, uppermost points K1 to K3 of the boundaries between the face parts 1 and the crown parts 2, that is, the above-described upper edge lines 110, are located further on the toe side in clubs having larger loft angles. The uppermost points K1 to K3 denote the highest position on the upper edge line 110 from the placement surface T. When the position where the extended line of the center axis Z of the shaft contacts the placement surface T is denoted as a reference point Q, the distances from the reference point Q to the uppermost points K1 to K3 are M1, M2, and M3, respectively, and the relationship M3>M2>M1 holds true. Specifically, for example, a configuration is possible in which M1=50.0 mm, M2=52.0 mm, and M3=54.0 mm, but the present invention is not limited thereto.

Figure 6:
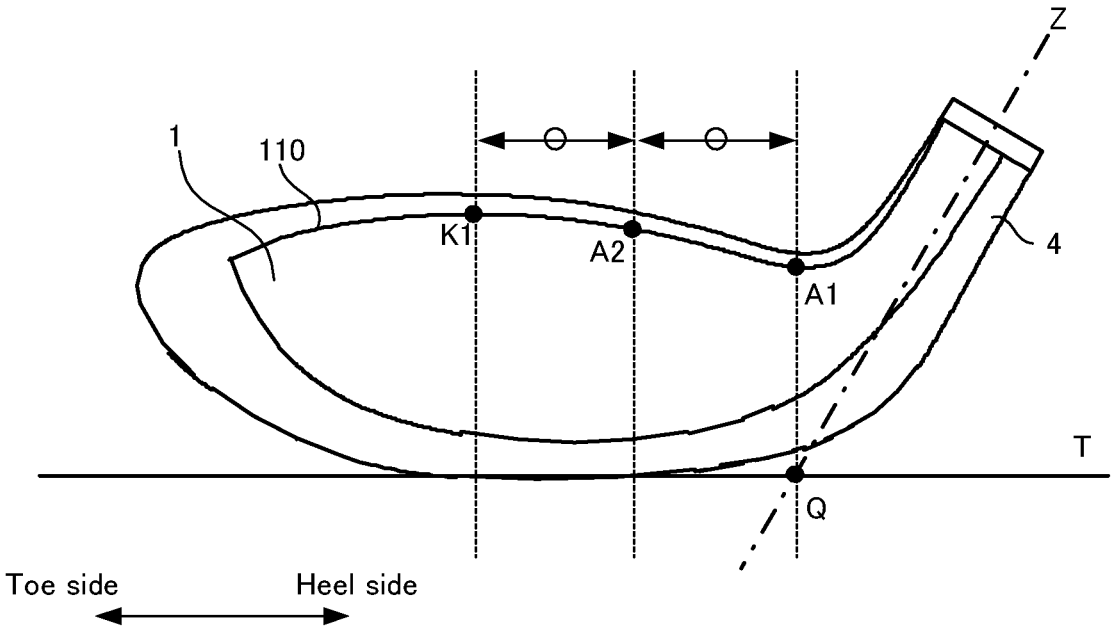
FIG. 6 is a front view of a golf club head, illustrating a face arc.

Also, the curvature radius of the upper edge line 110 can be set for each golf club in accordance with the loft angle. The upper edge line 110 curves so as to protrude upward, but the extent of curvature of the upper edge line 110 is different for each golf club. First, as shown in FIG. 6, taking U #3 as an example, the uppermost point K1, a point A1, and a point A2 are set on the upper edge line 110. The point A1 (heel-side endpoint) is an intersection point between the upper edge line 110 and a plane that passes through the point Q and is perpendicular to the toe-heel direction, and the point A2 is a midpoint between the uppermost point K1 and the point A1 in the toe-heel direction. Then, an arc (hereinafter referred to as "face arc") that passes through the point K1, the point A1, and the point A2 is defined. Here, when the curvature radii of the face arcs of the golf club heads (U #3, U #4, and U #5) are R1, R2, and R3, respectively, the relationship R3>R2>R1 holds true.

Furthermore, the difference between the curvature radii of the face arcs of clubs having consecutive numbers is preferably, for example, 1 to 70 mm. According to the present embodiment, the sense of incongruity felt at address between clubs having different numbers can be reduced, as will be described later, but the above range is specified because, especially if the difference between the curvature radii of the face arcs is too large, the shape of the face part 1 greatly varies between the club numbers, and thus the sense of incongruity felt at address between clubs having different numbers will increase. The curvature radius of the face arc may be, for example, 120 to 220 mm. Specifically, a configuration may be adopted in which R1=140 mm, R2=200 mm, and R3=220 mm, however, the present invention is not limited thereto.

6. Features

According to the above-described embodiment, the following effects can be achieved.

(1) In the golf clubs constituting the golf club set, the face parts 1 are configured such that clubs having larger loft angles have uppermost points K1 to K3 on the upper edge line 110 of the face part 1 that are located further on the toe side. As such, the following effect can be achieved.

Figure 7:
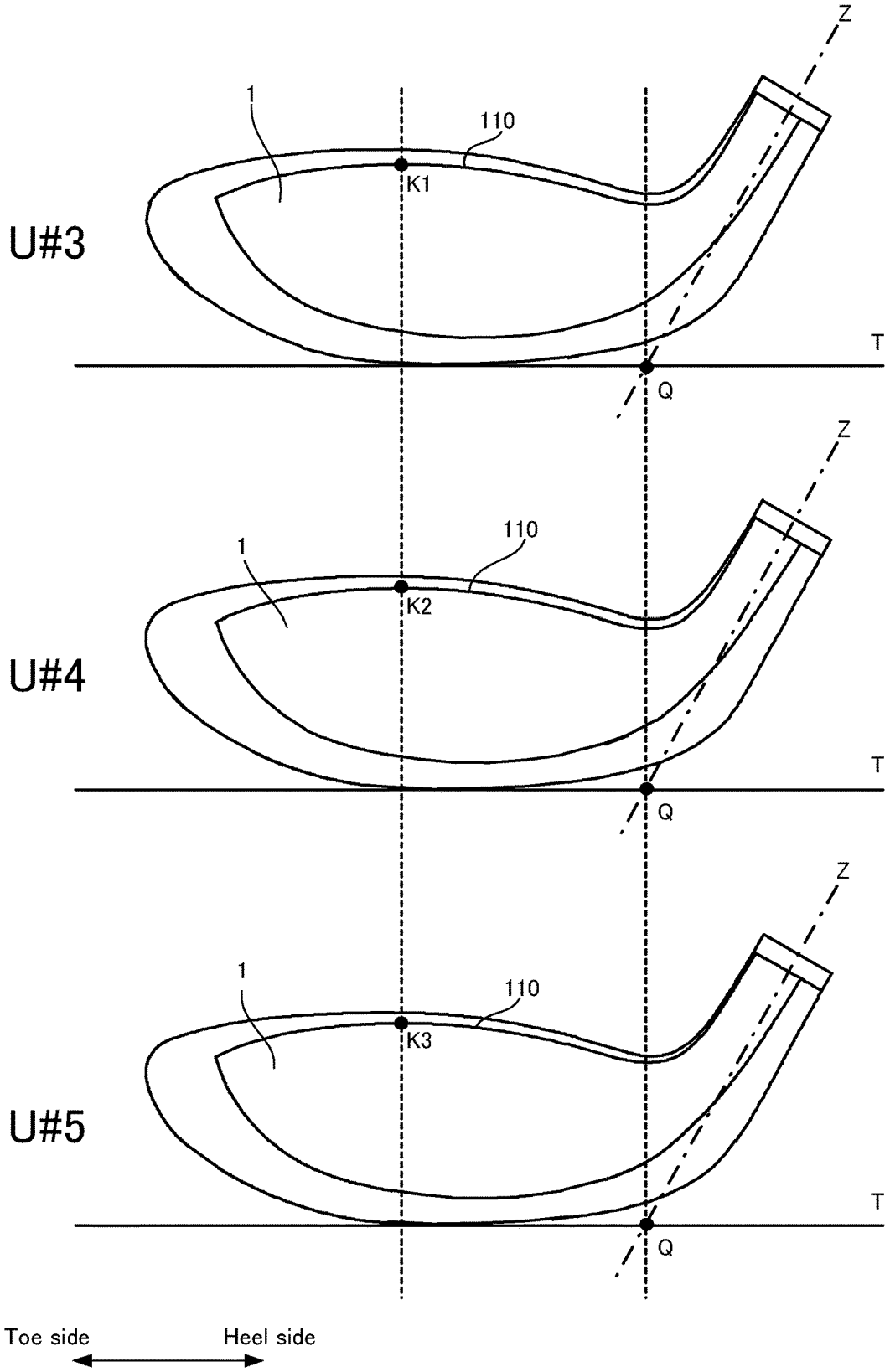
FIG. 7 is a front view of golf club heads having different loft angles that are included in a conventional golf club set.
Figure 8:
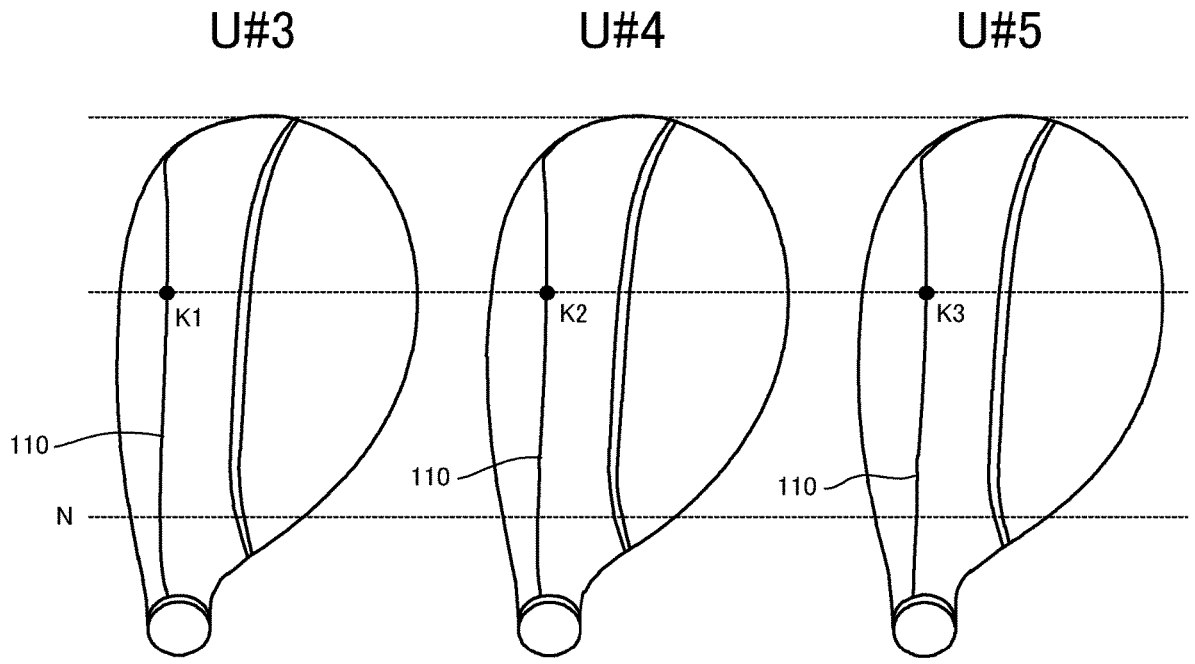
FIG. 8 is a plan view of FIG. 7.

First, in the conventional golf club set, the upper edge lines 110 in the face parts of the golf clubs have substantially the same shape even for clubs having different numbers. For example, as shown in FIG. 7, the upper edge line 110 curves so as to protrude upward for all of the golf clubs, and the positions of the uppermost points K1 to K3 in the toe-heel direction are substantially the same. As such, as shown in FIG. 8, when viewed from the golfer at address, golf clubs having higher loft angles have an upper edge line 110 that looks to be curved further toward the back as the upper edge line 110 progresses toward the toe. For this reason, the extent of curvature of the upper edge line 110 looks different for each club number, and therefore when the golfer changes the club, the golfer may feel a sense of incongruity at address, and thus find it difficult to address the ball. Also, if the upper edge line 110 greatly curves, there is a risk that the golfer will find it difficult to align the head in the target direction at address. In particular, if the golfer is right-handed, the golfer may feel that the ball will be hit leftward of the intended hitting direction.

Figure 9:
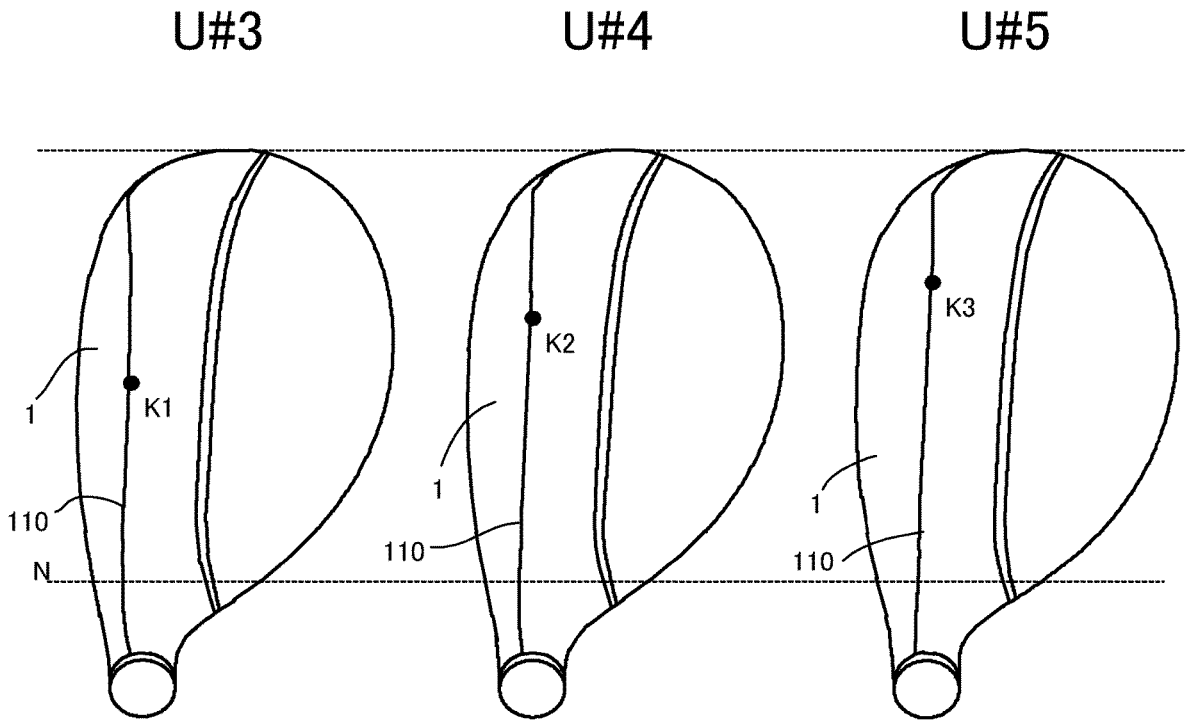
FIG. 9 is a plan view of golf club heads having different loft angles that are included in the golf club set according to the present invention.

In view of this, in the present embodiment, as described with reference to FIG. 5, the face parts 1 of the golf club heads (U #3, U #4, and U #5) are configured such that clubs having higher loft angles have uppermost points K1 to K3 on the upper edge lines 110 of the face part 1 that are located further on the toe side. Accordingly, as shown in FIG. 9, the upper edge line 110 tends to look like a straight line even for clubs having higher loft angles, and thus the sense of incongruity felt at address between clubs having different numbers can be reduced. As a result, addressing the ball after changing the club can be facilitated.

The following method is also conceivable in order to eliminate the sense of incongruity felt at address. That is, shifting the end portion on the toe side of the upper edge line 110 further toward the back in clubs having larger loft angles makes it possible for the upper edge line 110 to look like a straight line. However, in this case, there is a problem in that the bulge and roll of the face part 1 are also changed.

Accordingly, in present embodiment, as shown in FIG. 5, although the shape of the face part 1 varies between the club numbers, the end portion of the upper edge line 110 on the toe side is not shifted toward the back, and is changed mainly in the up-down direction, and thus it is possible to suppress the bulge and the roll from being changed. As a result, it is possible to reduce restrictions on design.

(2) In the crown part 2, the protruding part 21 is formed to be higher than the base part 22 via the sloped surface 23, and thus the height of the face part 1 can be increased by the amount by which the protruding part 21 rises. This makes it possible to improve the rebound performance at the face part 1. Additionally, only the protruding part 21 is formed to be higher in the crown part 2, whereas the base part 22, which occupies most of the crown part 2, is formed in a position that is lower than the protruding part 21. This makes it possible to lower the center of gravity of the head.

7. Variations

An embodiment of the present invention has been described above. However, the present invention is not intended to be limited to the above-described embodiment. Many modifications can be made thereto without departing from the spirit of the present invention. The following variations can also be combined as appropriate. The following variations are possible, for example.

7.1

Although the above-described embodiment describes locating the upper most points K1 to K3 of the upper edge line 110 further on the toe side in clubs having higher loft angles, this relationship does not necessarily have to hold true for all of the consecutive-numbered golf clubs in the golf club set. In other words, it is sufficient for the relationship to hold true for at least two clubs having a higher loft angle and a lower loft angle in the golf club set. Thus, for example, in the four clubs U #3 to U #6, when the distances between the reference point Q and the uppermost points K1 to K4 in the toe-heel direction are denoted as M1, M2, M3, and M4, respectively, the relationships therebetween can be set to M1<M2=M3<M4, or to M1<M2<M3=M4. Note that, in any two golf clubs of the golf club set, the club having a lower loft angle corresponds to the first golf club of the present invention, and the club having a higher loft angle corresponds to the second golf club of the present invention.

The above-described embodiment describes increasing the curvature radius of the face arc of the upper edge line 110 in clubs having larger loft angles, but the golf clubs need not necessarily be formed in such a manner. Specifically, as described above, as long as the positional relationship between the uppermost points K1 to K3 in the clubs holds true, the curvature radii of the face arcs may be the same, or the curvature radius of the face arc may be reduced as the loft angle increases. Note that, increasing the curvature radius of the face arc as the loft angle increases makes it easier to design golf club heads such that the positional relationship between the uppermost points K1 to K3 satisfy the above-described relationship.

7.3

Although the head widths and the head thicknesses are the same for all of the clubs in the above-described embodiment, the head widths and the head thicknesses do not absolutely need to be the same, and can instead be set to vary.

7.4

Although the crown part 2 of the head includes the protruding part 21 in the foregoing embodiment, the shape of the protruding part 21 is not particularly limited. A crown part 2 not having the protruding part 21 is also possible. Also, the shape of the sole part 3 is not particularly limited.

7.5

The "golf club set" according to the present invention refers to a golf club set including the same type of golf clubs, and a single golf club set includes only utility type golf clubs as described above. However, in addition to utility type golf clubs, the golf club set according to the present invention can also be constituted by golf clubs having wood type heads such as fairway woods, or iron type heads, for example.

LIST OF REFERENCE NUMERALS

1 Face part
110 Upper edge line
2 Crown part
3 Sole part
4 Hosel part

What is claimed is:

1. A golf club set constituted by at least first, second, and third golf clubs having different loft angles, wherein
- each of the golf clubs includes a shaft and a golf club head,
- each of the golf clubs has a wood type or hybrid type golf club head,
- each of the golf club heads includes:
  - a crown part;
  - a face part;
  - a sole part; and
  - a hosel part to which the shaft is attached,
- in the face part, an upper edge line that is a boundary with the crown part curves so as to protrude upward,
- the loft angle of the first, the second, and the third golf club gets larger in this order,
- out of uppermost points of the upper edge line of each of the golf clubs, in a reference state, the uppermost point of the first golf club is located further on a heel side, and the uppermost point of the third golf club is located further on a toe side,
- when a curvature radius of an arc that passes through three points on the upper edge line of each of the golf clubs is defined, the three points being
  - the uppermost point,
  - a heel-side end point that is an intersection point between the upper edge point and a plane that passes through an intersection point between a center axis line of the shaft in the reference state and a placement surface of the golf club head and is perpendicular to the toe-heel direction, and
  - a midpoint between the uppermost point and the heel-side end point in the toe-heel direction,
- the curvature radius of the second golf club is larger than the curvature radius of the first golf club, and
- a difference between the curvature radius of the first golf club and the curvature radius of the second golf club is within 70 mm.

2. The golf club set according to claim 1, wherein
- when an intersection point between a center axis line of the shaft in the reference state and a placement surface of the golf club head, and the first distance between the intersection point and the uppermost point in the toe-heel direction is defined,
- the first distance of the second golf club is longer than the first distance of the first golf club.

3. The golf club set according to claim 1, wherein the crown portion of the golf clubs includes:
- a protruding part extending in a toe-heel direction along at least part of the face portion;
- a base part arranged further on a back side than the protruding part; and
- a step region extending in the toe-heel direction between the first region and the second region, and extending downward toward the second region from the first region side.

4. A golf club set constituted by at least first, second, and third golf clubs having different loft angles, wherein
- each of the golf clubs includes a shaft and a golf club head,
- each of the golf clubs has a wood type or hybrid type golf club head,
- each of the golf club heads includes:
  - a crown part;

a face part;

a sole part; and a hosel part to which the shaft is attached, in the face part, an upper edge line that is a boundary with the crown part curves so as to protrude upward, the loft angle of the first, the second, and the third golf club gets larger in this order, out of uppermost points of the upper edge line of each of the golf clubs, in a reference state, the uppermost point of the first golf club is located further on a heel side, and the uppermost point of the third golf club is located further on a toe side, when a curvature radius of an arc that passes through three points on the upper edge line of each of the golf clubs is defined, the three points being the uppermost point, a heel-side end point that is an intersection point between the upper edge point and a plane that passes through an intersection point between a center axis line of the shaft in the reference state and a placement surface of the golf club head and is perpendicular to the toe-heel direction, and a midpoint between the uppermost point and the heel-side end point in the toe-heel direction, the curvature radius of the second golf club is larger than the curvature radius of the first golf club, and the golf clubs include a golf club that has a curvature radius of 120 to 220 mm.

5. The golf club set according to claim 4, wherein when an intersection point between a center axis line of the shaft in the reference state and a placement surface of the golf club head, and the first distance between the intersection point and the uppermost point in the toe-heel direction is defined, the first distance of the second golf club is longer than the first distance of the first golf club.

6. The golf club set according to claim 4, wherein the crown portion of the golf clubs includes:

a protruding part extending in a toe-heel direction along at least part of the face portion;

a base part arranged further on a back side than the protruding part; and a step region extending in the toe-heel direction between the first region and the second region, and extending downward toward the second region from the first region side.

* * * * *